United States Patent [19]

Ijima

[11] 4,154,548

[45] May 15, 1979

[54] MULTI-WALLED BREAKWATER

[76] Inventor: Takeshi Ijima, 979 Imajukuaoki, Nishi-ku, Fukuoka, Japan

[21] Appl. No.: 848,203

[22] Filed: Nov. 3, 1977

[51] Int. Cl.[2] ..... E02B 3/06

[52] U.S. Cl. ..... 405/30; 405/211

[58] Field of Search ..... 61/3, 4, 86, 2, 5, 102

[56] References Cited

U.S. PATENT DOCUMENTS

| | | | |
|---|---|---|---|
| 3,118,282 | 1/1964 | Jarlan | 61/4 |
| 3,387,458 | 6/1968 | Jarlan | 61/3 |
| 3,952,520 | 4/1976 | Shillingford | 61/49 X |
| 4,019,332 | 4/1977 | Lamy | 61/4 |

FOREIGN PATENT DOCUMENTS

| | | | |
|---|---|---|---|
| 1444835 | 8/1976 | United Kingdom | 61/4 |

*Primary Examiner*—Jacob Shapiro

[57] ABSTRACT

A breakwater which has a rear wall and several front walls to break up the incident waves, the front walls having holes therein to pass the waves, which holes diminish in size from the front wall which takes the initial impact of the wave towards the back wall. In various embodiments the breakwater may have a sloping back wall, convex-concave indentations on the back wall, partitions dividing up into compartments the chambers in front of the back wall, and a sloping second wall.

14 Claims, 19 Drawing Figures

MULTI-WALLED BREAKWATER

This invention relates to a sea wall which is capable of blocking a variety of waves having a wide range of wave lengths and is applicable to a breakwater or the like.

In general, along the edge of the water in a harbour there is built a sea wall having a uniform planar vertical front surface. In this case, however, an incident wave is reflected by the wall directly. Accordingly, the height of the wave in front of the wall becomes extremely large because of the overlap of the incident and the reflected waves, which is inconvenient for navigation of ships, loading, unloading, or the like. Furthermore, the dashing of the waves against the wall is severe.

It is an object of the present invention to provide a sea wall having effective blocking ability against a variety of waves having a wide range of wave lengths.

This object is accomplished by a sea wall including a plurality of front walls having different sized openings in front of a back wall, the front walls being separated from one another.

Other objects, features, and advantages of the present invention will be apparent from the following description of the prior art and the present invention when taken in connection with the accompanying drawings, in which:

FIG. 1 is a transverse sectonal view of a conventional sea wall;

FIG. 2 graphically illustrates the blocking ability of a conventional sea wall;

Figure 3:
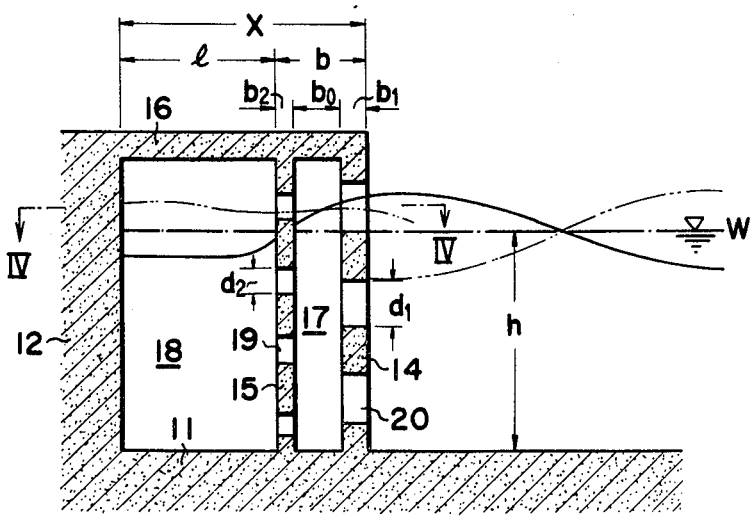
FIG. 3 is a transverse sectional view of a sea wall according to the present invention.
Figure 5:
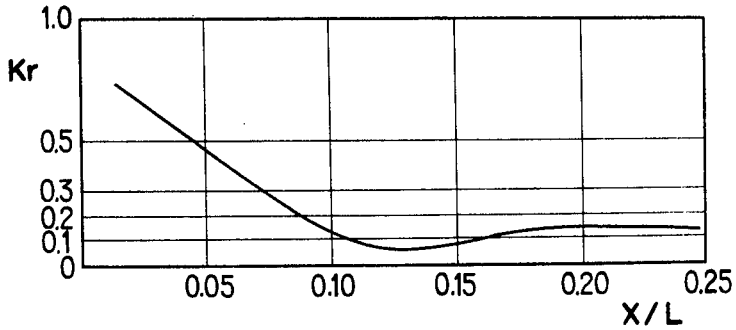
Figure 6:
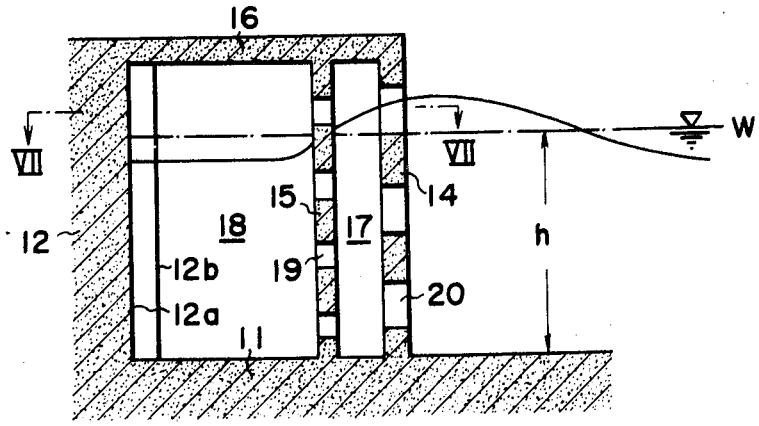
Figure 7:
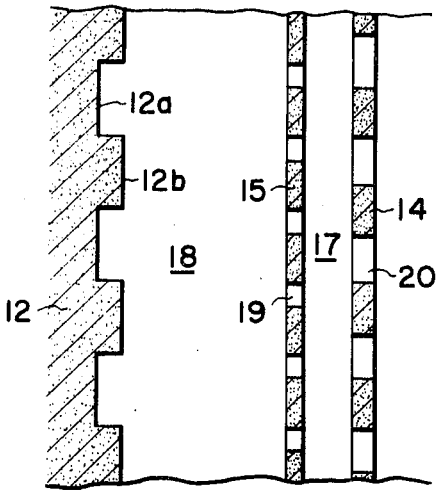
Figure 8:
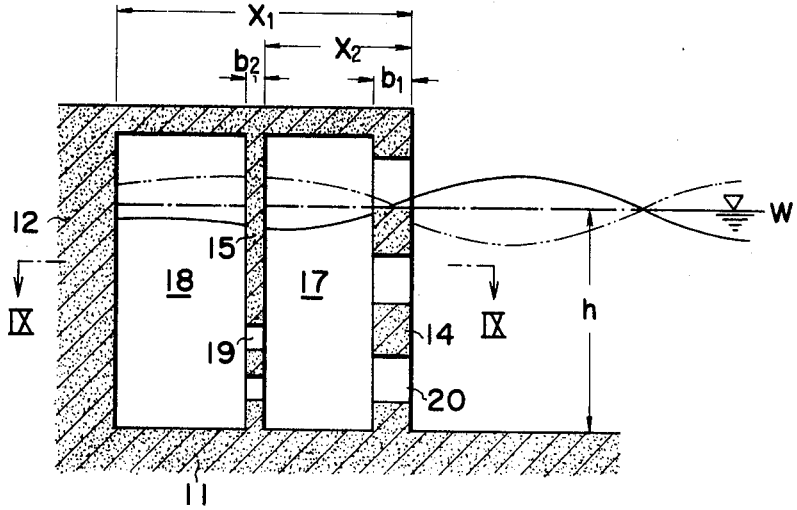
Figure 9:
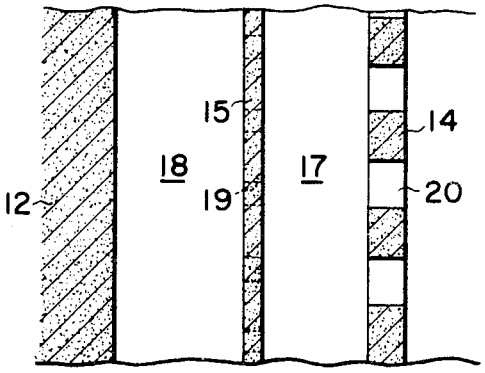
Figure 10:
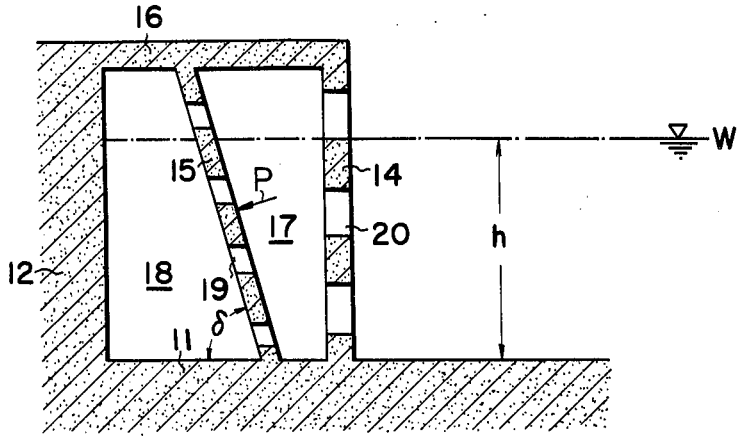
Figure 11:
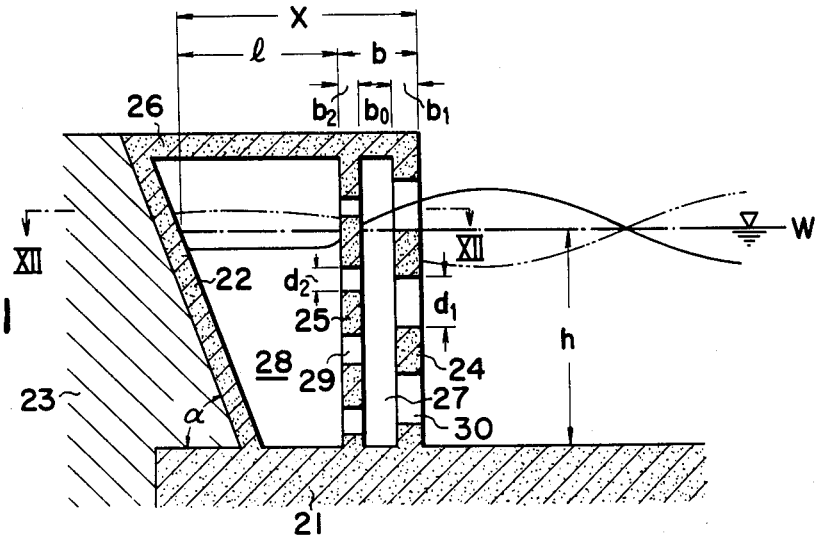
Figure 12:
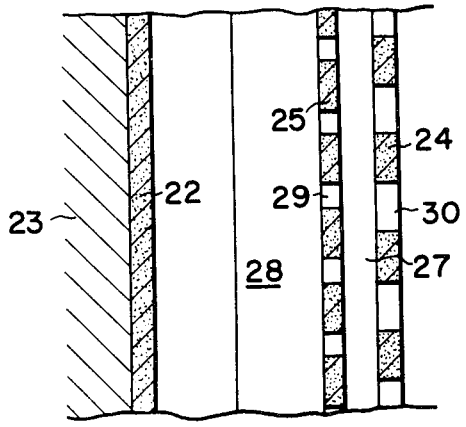
Figure 13:
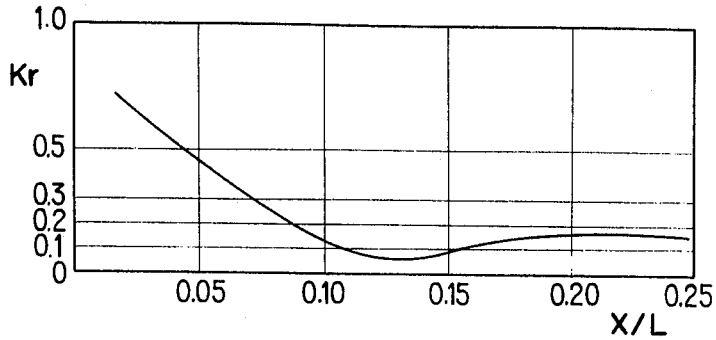
Figure 14:
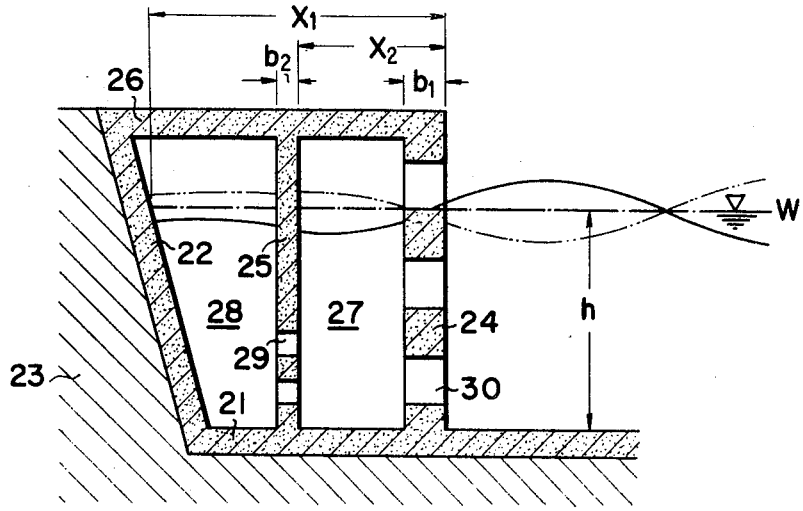
Figure 15:
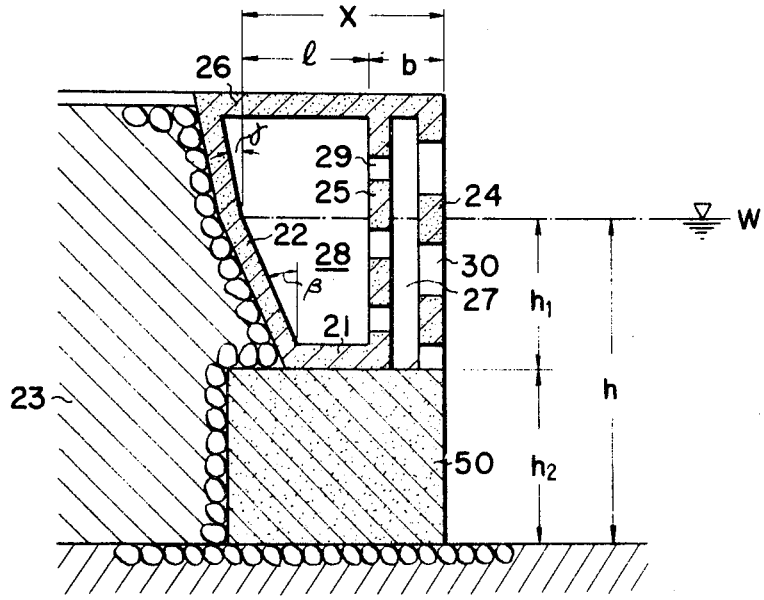
Figure 16:
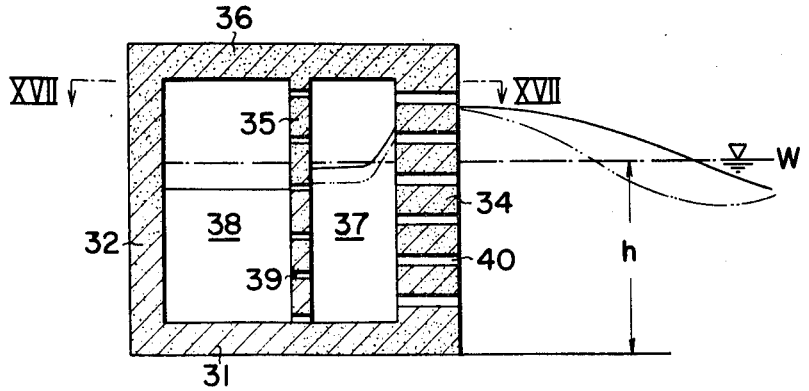
Figure 17:
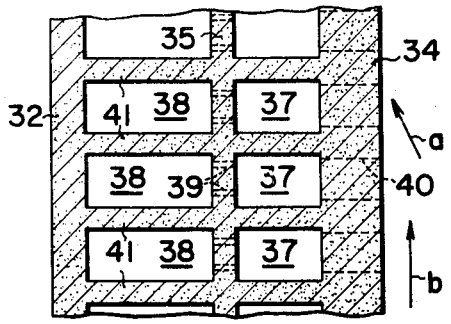
Figure 18:
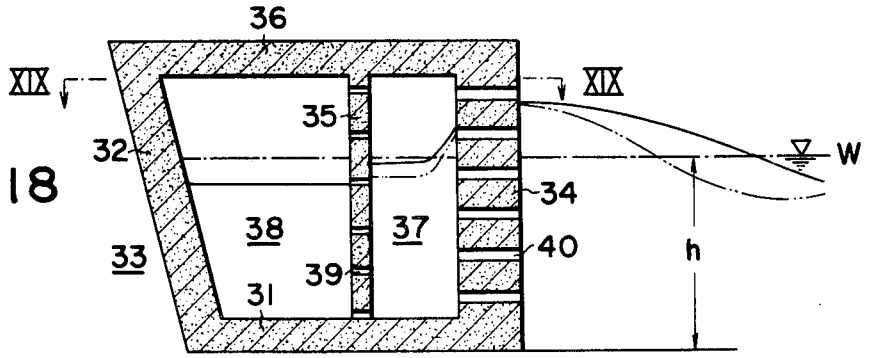
Figure 19:
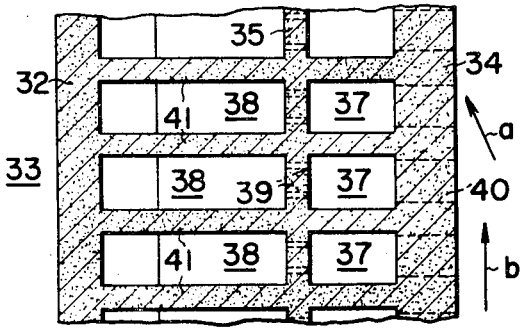

FIG. 5 graphically illustrtes the blocking ability of the sea wall shown in FIG. 3;

FIG. 6 is a transverse sectional view of another sea wall according to the present invention;

FIG. 7 is a sectional plan view of the sea wall of FIG. 6 taken along the line VII—VII;

FIG. 8 is a transverse sectional view of another sea wall according to the present invention;

FIG. 9 is a sectional plan view of the sea wall of FIG. 8 taken along the line IX—IX;

FIG. 10 is a transverse sectional view of another sea wall according to the present invention;

FIG. 11 is a transverse sectional view of another sea wall according to the present invention;

FIG. 12 is a sectional plan view of the sea wall of FIG. 11 taken along the line XII—XII;

FIG. 13 graphically illustrates the blocking ability of the sea wall shown in FIG. 11;

FIG. 14 is a transverse sectional view of another sea wall according to the present invention;

FIG. 15 is a transverse sectional view of still another sea wall according to the present invention;

FIG. 16 is a transverse sectonal view of another sea wall according to the present invention;

FIG. 17 is a sectional plan view of the sea wall of FIG. 16 taken along the line XVII—XVII;

FIG. 18 is a transverse sectional view of yet another sea wall according to the present invention; and FIG. 19 is a horizontal sectional view of the sea wall of FIG. 18 taken along the line XIX—XIX.

Figure 1:
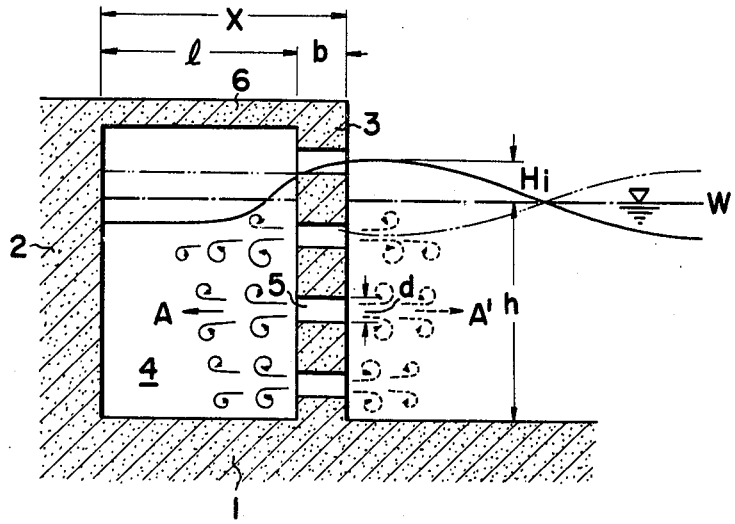

Referring first to a conventional sea wall illustrated in FIG. 1:

The sea wall comprises a base 1 on the sea bottom, an impermeable back wall 2 standing vertically on the base 1, its top end being higher than the water level, a front wall 3 with a plurality of holes 5 which stands vertically at a distance from the back wall 2 on the base 1 and which has the same height as the back wall 2, a slab 6 which projects horizontally frontwards from the top end of the back wall 2 and which is connected to the top end of the front wall 3, and a chamber 4 between the back wall 2 and the front wall 3, the upper part of which vents to the atmosphere and the lower part of which is under the water level.

When the wavecrest arrives at the front wall 3, as shown in FIG. 1, the water level in front of the front wall 3 rises, and the water rushes into the chamber 4 through the holes 5 of the front wall 3 according to the relative water level difference between the chamber 4 and the water in front of the front wall 3.

Then the energy of the wave is partly converted into energy of vortices A generated at the holes 5.

When the water level in the chamber 4 rises after the half period point of the wave, and the exterior water level drops, as shown in FIG. 1 by a two-dotted line, the water in the chamber 4 rushes out of the chamber 4 through the holes 5, and more of its energy is converted into energy of the vortices A′ generated at the holes 5.

Thereby the wave is blocked by the sea wall.

The amount of the energy loss of the wave due to the vortices A and A′ is in proportion to the cube of the flow speed of the water through the holes 5. The blocking ability against the wave relates to the thickness b of the front wall 3, the diameter d of the holes 5, the opening ratio V of the front wall 3 and the width 1 of the chamber 4.

To obtain the maximum blocking ability, that is, to minimise the height of the reflected wave, we find that the best results are obtained when the diameter d of the holes 5 is roughly the same as the wave height $H_i$, i.e., $d \sim H_i$, the opening ratio of the front wall 3 is 20%–35%, the thickness b of the front wall 3 is 205–40% of the water depth h and the entire width X, which is the sum of the width 1 of the chamber 4 and the thickness b of the front wall 3, is approximately 15% of the wave length L.

Figure 2:
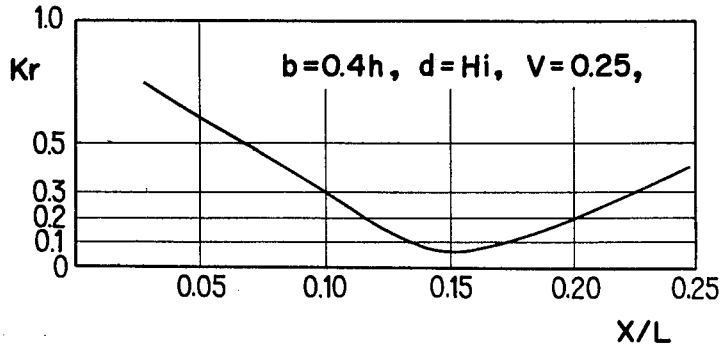

With these results, if a sea wall is designed with the fixed width X, and the reflectivity $K_r$, i.e., the ratio of reflected wave height to incident wave height, is measured for waves of various wave lengths and is plotted on a graph with the reflectivity $K_r$ along the horizontal axis and X/L along the vertical axis, a graph as shown in FIG. 2 results.

From this graph, it is readily understood that the reflectivity $K_r$ is minimum when X/L is approximately 0.15. Considering that reflectivity of 0.3 or less is sufficient to obtain a desirably calm state of the water, such a sea wall exhibits remarkably good blocking ability against waves of which the wave length L is approximately X/0.15.

However, the range of wave lengths against which blocking ability is good is very narrow. When the wave length becomes shorter or longer than the abovementioned value, the reflectivity $K_r$ increases abruptly. Consequently, the blocking ability of the conventional sea wall is not enough against a variety of waves having a wide range of wavelengths.

Figure 4:
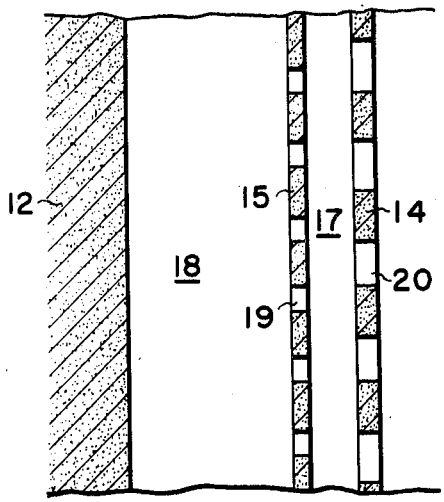
FIG. 4 is a sectional plan view of the sea wall of FIG. 3 taken along the line IV—IV.

Referring to FIGS. 3 and 4 of the drawings, there is shown a sea wall including a base 11 on the sea bottom and an impermeable back wall 12 which stands vertically on the base 11 and is higher than the water level W. The first front wall 14 and the second front wall 15 situated behind, away from, and parallel to the first front wall 14 stand vertically on the base 11 in front of the back wall 12 and have the same height as the back wall 12.

The top ends of both the first and the second front wall 14 and 15 are integrally connected to a support slab 16 which projects from the top end of the back wall 12.

The first front wall 14 and the second front wall 15 have a plurality of circular holes 20 and 19, respectively, which are uniformly distributed and whose axes are horizontal. The diameter $d_1$ of the holes 20 is larger than the diameter $d_2$ of the holes 19. All the holes 20 and 19 are arranged so that none of them have a common axis.

The shape of the holes 19 and 20 may also be polygonal, as an alternative.

The thickness $b_1$ of the first front wall 14 is larger than the thickness $b_2$ of the second front wall 15.

The first chamber 17 is defined by the first and the second front walls 14 and 15, the base 1 and the support slab 16, and the second chamber 18 is defined by the second front wall 15, the back wall 12, the base 11 and the support slab 16, as shown in FIG. 3.

The upper part of each of the first and the second chambers 17 and 18 vents to the atmosphere via the holes 19 and 20 and the lower part of each chamber 17 and 18 leads to the water via the holes 19 and 20.

The width 1 of the second chamber 18 is larger than the width $b_0$ of the first chamber 17, and, for example, may be several times larger.

The widths 1 and $b_0$ of the first and the second chambers, the thicknesses $b_1$ and $b_2$ of the first and the second front walls and the diameters $d_1$ and $d_2$ of the holes in the first and the second front walls, mentioned above, may be changed, as occasion demands.

When the wave-crest arrives at the first front wall 14, as shown in FIG. 3, the water level before the first front wall 14 rises. Thus the water rushes into the first chamber 17 through the holes 20 according to the level difference between the water in the first chamber 17 and the water before the first front wall 14. Further, the water in the first chamber 17 rushes into the second chamber 18 through the holes 19. The wave energy is partly dissipated into vortices generated at the holes 19 and 20.

When the water level in the second chamber 18 rises after the half period point of the wave, and the exterior water level drops, as shown in FIG. 3 by a two-dotted line, the wave-trough reaches the first front wall 14 and the water level before the first front wall descends. The water in the second chamber 18 rushes out of the second chamber 18 to the first chamber 17 through the holes 19 and then out of the first chamber 17 to the outside through the holes 20. The wave is further weakened by the vortices generated at the holes 19 and 20.

As described above, the wave is de-energized by the vortices generated at both sides of the first and the second front walls 14 and 15, and thereby the wave is blocked by the sea wall. Furthermore, the sea wall blocks a variety of waves having a wide range of wave lengths, since the holes 19 and 20 are arranged not to have common axes.

The measured reflectivity of the sea wall shown in FIGS. 3 and 4 is shown in FIG. 5 in the same manner as FIG. 2.

It is readily understood from FIG. 5 compared with FIG. 2 that the sea wall of the present invention exhibits blocking ability not only to waves having a long wave length but also to waves having a short wave length, and its application range is much wider than that of a conventional one.

Considering a wave having a short wave length, the reflectivity $K_r$ does not increase much and holds in a range of 0.1–0.2. The reflectivity $K_r$ is generally low with respect to X/L. Consequently, it is apparent that the sea wall of the present invention has a superior blocking ability as compared with that of FIG. 2.

That is, considering a wave having a long wavelength, as apparent from FIG. 5, the first and the second front walls act as a single wall having the width $b=b_0+B_1+b_2$ against the wave, and exhibit the minimum value of reflectivity $K_r$ when X/L is equal to 0.12.

Accordingly, the whole width X is approximately 12% of the wave length L. The sea wall which has a shorter whole width, i.e., $X \approx 0.12$ L, than that of the conventional sea wall having a single front wall, when $X=0.15$ L, exhibits sufficient blocking ability.

Further, in the conventional sea wall having a single front wall, the energy loss is caused by the vortices generated at both sides of the front wall. However, in the sea wall of the present invention having two front walls, the energy loss is caused by the vortices generated at both sides of both front walls. Hence, both the thicknesses $b_1$ and $b_2$ of the first and the second front walls 14 and 15 can be formed to be thinner than that of the conventional sea wall having a single front wall.

From these facts, it becomes possible to reduce the amount of material to be used for the sea wall and the weight of the same, as compared with the conventional sea wall having a single front wall.

Referring to FIGS. 6 and 7, there is shown another sea wall according to the present invention. This sea wall is the same as described above except that the back wall surface has alternate concave surfaces 12*a* and convex surfaces 12*b* in the horizontal direction at a certain distance apart.

In this case, the development of the vortices in the second chamber 18 is promoted by the concave-convex shaped back wall. More effective blocking ability is obtained.

In FIGS. 8 and 9, there is shown still another sea wall according to the present invention.

In this case, the thickness of the second front wall 15 is $\frac{1}{3}$–$\frac{1}{4}$ of that of the first front wall 14, and the opening ratio of the second front wall 15 is $\frac{1}{3}$–$\frac{1}{4}$ of that of the first front wall 14. The width of the first chamber 17 is almost the same as that of the second chamber 18. The holes 19 of the second front wall 15 are formed at its lower part under the water level. The second chamber 18 does not vent to the atmosphere, but leads to the water of the first chamber via the holes 19.

Since the second chamber 18 is closed to the atmosphere, the air existing in the upper part of the second chamber 18 acts as a damper when the water comes in or goes out. Accordingly, the resistance which the water undergoes is quite large and the energy loss of the wave is very large.

That is, when a wave having a wave length of $L_1=X_1/0.12$ relative to the width $X_1$, which is from the first front wall 14 to the back wall 12, is incident, in accordance with the long wavelength. The water flows freely through the holes 19 of the second front wall 15, and the second chamber 18 exhibits the same extent of blocking ability as a sea wall including no second front wall.

Meanwhile, when a wave having a wave length of $L_2 = X_2/0.12$ relative to the width $X_2$ which is from the first front wall 14 to the second front wall 15, is incident, according to the short wavelength, the second front wall 15 exhibits a large resistance to the water flow, i.e., a similar action to a wall including no opening. Therefore, against such a wave having a short period, this sea wall exhibits the blocking ability of a sea wall having a whole width of $X_2$.

To block waves having a range of wavelengths from $L_1$ to $L_2$, a sea wall having uniform blocking ability over the range is provided by forming the first and the second front walls so that $X_1$ is approximately equal to 0.12 $L_1$ and $X_2$ is approximately equal to 0.12 $L_2$. For instance, when the water depth h is 8 meters, $L_1$ is 84 meters, and $L_2$ is approximately 35 meters, against the wave having a period of 5–10 seconds. Thus, assuming that $X_1$ is approximately 10 meters and $X_2$ is approximately 4.2 meters, a sea wall which exhibits uniform blocking ability $K_r \approx 0.1$–$0.2$ against such waves is constructed.

Referring to FIG. 10, there is shown another sea wall according to the present invention. This sea wall has the same construction as the one shown in FIG. 3, except that the second front wall 15 inclines at an angle $\delta$ away from the sea, so that its upper part is closer to the back wall than its lower part.

It is readily understood that the sea wall has the same results as those of that of FIG. 3. Further, when the wavecrest arrives at the first front wall 14, the water rushes into the first chamber 17 through the holes 20 and then strikes against the second front wall 15. Since the second front wall 15 inclines, and the water pressure P acts perpendicularly to it, the horizontal component P′ of the pressure P is equal to P sin $\delta$ and the vertical component P″ of the pressure P is equal to P cos $\delta$. The vertical component P″ contributes to the stability of the sea wall.

Referring to FIGS. 11 and 12, there is shown still another sea wall according to the present invention. This sea wall is the same as the one shown in FIG. 3, except that the back wall 22 inclines at an angle $\alpha$ away from the sea, so that its upper part is farther from the sea than its lower part. The inclined back wall 22 adjacent to the bank 23 stands on the base 21. The first front wall 24 and the second front wall 25 separated from each other stand vertically on the base 21. The support slab 26 projects from the top end of the back wall 22. The front end of the support slab 26 is integrally connected to the top ends of the first and the second front walls.

The first front wall 24 and the second front wall 25 include a plurality of holes 30 and 29 respectively.

The first chamber 27 is situated between the first and the second front walls 24 and 25 and the second chamber is situated between the second front wall 25 and the back wall 22.

When the wavecrest arrives at the first front wall 24 as shown in FIG. 11 the water level before the first front wall 24 rises. The water rushes into the first chamber 27 and further into the second chamber 28 in the same manner as described above. The wave energy is partly dissipated into the vortices generated at the holes 29 and 30.

The water further rushes against the inclined back wall 22, and vortices turning downwards are generated according to the difference of the upper and the lower water flow speeds, since the back wall 22 inclines, and the water flow speed in fastest in the water surface and decreases with depth. That is, the energy of the wave is partly converted into the energy of the vortices in this region.

When the water level in the second chamber 28 rises after the half period time of the wave, and the exterior water level drops, as shown in FIG. 11 by a two-dotted line, the wavetrough arrives at the first front wall 24. Then, the water rushes out of the second and the first chambers 28 and 27 through the holes 29 and 30. The wave is further de-energized by the vortices generated at the holes 29 and 30. Accordingly, the wave is blocked by the sea wall.

The inclined back wall 22 promotes the generation of the vortices adjacent to the back wall 22 in the second chamber 28 and minimizes the influence of the bank pressure against the sea wall.

The measured reflectivity of the sea wall shown in FIGS. 11 and 12 is shown in FIG. 13 in the same manner as in FIG. 5.

The same results are obtained as described in reference to the sea wall shown in FIGS. 3–5.

In this case, in the same way as in the sea wall shown in FIGS. 3 and 4, it becomes possible to shorten the whole width X and to reduce the weight of the sea wall. However, the weight reduction of the sea wall generally causes a strength drop for supporting the sea wall from the bank pressure. This is overcome, thereby minimizing the influence of the bank pressure, by means of the inclination of the back wall at the angle $\alpha$ away from the sea as described above. For example, assuming that the angle $\alpha$ of inclination is 60°, the bank pressure is decreased 40%, as compared with the case of a vertical back wall.

By inclining the back wall, the width 1 of the second chamber 28 is substantially shortened but this does not reduce the blocking ability of the sea wall. In this case, the whole width X is measured at the water surface. Considering the horizontal water flow in the second chamber 28, the closer to the water surface, the faster is the water flow speed. Hence, considering now a sea wall including a vertical back wall, the lower water adjacent to the back wall does not substantially contribute to generating vortices which dissipate the energy of the wave. Accordingly, even if this non-contributory portion is removed by inclining the back wall away from the sea, the blocking ability of the sea wall is not reduced.

In FIG. 14 there is shown another sea wall according to the present invention.

This sea wall is the same as the one shown in FIG. 8 except that the back wall 22 inclines at an angle $\alpha$ away from the sea in the same manner as the sea wall shown in FIG. 11.

It is readily understood that the same results may be obtained as compared with the sea wall shown in FIG. 8.

In FIG. 15, there is shown still another sea wall according to the present invention.

The sea wall is constructed on a base block 50 formed on the foundation of the sea bottom, having a height $h_2$.

The depth $h_1$ under the water level of the sea wall is greater than or equal to 30% of the sea depth h.

The base block 50 constitutes a wall for supporting the bank 23 together with the sea wall.

The sea wall is the same as the one shown in FIG. 11 except that the upper part of the back wall 22 which inclines at an angle $\beta$ with respect to the vertical, bends frontwards at an angle $\gamma$ with respect to the vertical at the water level.

The vertical front surface of the base block 50 is in the same plane as the vertical front surface of the first front wall 24.

In this case, since the sea wall is constructed on the base block 40, it is very easy to build the sea wall in comparison with one constructed directly on the sea bottom. Further, part of the bank pressure is supported by the base block, and the sea wall together with the base block constitutes a rigid wall against the bank pressure.

This sea wall is conveniently constructed at a place where the water is deep.

Referring to FIGS. 16 and 17, there is shown still another sea wall according to the present invention.

This sea wall is the same as the one shown in FIGS. 3 and 4 except for the addition of a plurality of vertical partition walls 41 which cross transversely the whole width of the sea wall in the longitudinal direction at certain intervals.

The widths of the first and the second chambers 37 and 38, the thicknesses of the first and the second front walls 34 and 35, the sizes and the shapes of the holes 40 and 39 formed on the first and the second front walls and the distance between two partition walls may be desirably selected according to a wave length to be blocked.

The water transmittance of the second front wall 35 may be approximately $\frac{1}{3}$ of that of the first front wall 34.

The wave is blocked by the sea wall in the same manner as described above, when the incident wave is perpendicular to the sea wall, i.e., the first front wall.

Further, when a wave such as one not perpendicular to the sea wall, as shown in FIG. 17 by an arrow a, or a wave parallel to the sea wall, such as shown in FIG. 17 by an arrow b, is incident upon the sea wall, the water surface before the sea wall repeats up and down alternately by the passing wave since the first and the second chambers 27 and 28 are separated by the partition walls 41 into compartments in the longitudinal direction. The waves are blocked by the sea wall in the same way as the right-angle incident waves, due to the provision of the partitions, since water cannot flow from one compartment to the next, although their oscillations are out of phase with one another. It is apparent that an inclined-angle incident wave and a parallel incident wave as well as a perpendicular incident wave are blocked by the sea wall of the present invention.

In FIGS. 18 and 19 there is shown still another sea wall according to the present invention. This sea wall has the same construction as the one shown in FIG. 11 except for the addition of a plurality of vertical partition walls 41, which cross transversely the whole width of the sea wall, in the longitudinal direction at certain intervals.

Results are obtained similar to those described above.

As described hereinbefore, it is readily understood that a variety of waves having a wide range of wavelengths are blocked by the sea wall according to the present invention.

The sea wall according to the present invention may be constructed in various conventional manners, such as by piling up a combination of a variety of blocks, forming integrally by concrete, i.e. the caisson system, and the like.

Further, although the present invention has been described with particular reference to a sea wall which absorbs the impact of incident waves, it should be understood that it can be applied to any situation where any kind of breakwater to reduce wave impact is required.

I claim:

1. A breakwater comprising a base on the water bottom; a back wall which stands on the base and rises above the water level; a plurality of front walls which stand on the base, are separated from one another and have the same height as the back wall; and a support slab which projects horizontally from the top end of the back wall and is connected to the top ends of the front walls; each front wall being pierced by a plurality of holes, the dimensions of the holes of the front walls decreasing monotonically from the first wall situated at the front of the breakwater to the last wall closest to the back wall.

2. A breakwater according to claim 1, wherein the plurality of front walls consists of a first vertical front wall and a second vertical front wall situated behind the first vertical front wall, a first chamber being defined between the first front wall and the second front wall and a second chamber being defined between the second front wall and the back wall.

3. A breakwater according to claim 2, wherein the back wall is substantially a vertical plane surface.

4. A breakwater according to claim 3, wherein the thickness of the second front wall is in a range of $\frac{1}{3}$ to $\frac{1}{4}$ of that of the first front wall.

5. A breakwater according to claim 4, wherein the ratio of the area of the holes to the area of the solid surface of the first front wall is in a range of $\frac{1}{3}$ to $\frac{1}{4}$ of that of the second front wall.

6. A breakwater according to claim 3, wherein the transverse dimension of the first chamber is substantially the same as that of the second chamber, wherein the upper part of the first chamber vents to the atmosphere via the holes in the first front wall and the lower part of the first chamber leads to the water via the holes in the first front wall and wherein the upper part of the second chamber is isolated from the atmosphere and the lower part of the second chamber leads to the water in the first chamber via the holes in the second front wall.

7. A breakwater according to claim 3, wherein the back wall includes concave surfaces and convex surfaces alternating in the horizontal direction at a certain distance apart from one another.

8. A breakwater according to claim 2, wherein the second front wall inclines away from the incident wave direction so that its upper part is closer to the back wall than its lower part.

9. A breakwater according to claim 1, wherein the back wall inclines away from the incident wave direction so that its upper part is farther from the incident wave direction than its lower part.

10. A breakwater according to claim 2, wherein the back wall inclines away from the incident wave direction so that its upper part is farther from the incident wave direction than its lower part.

11. a breakwater according to claim 10, wherein the transverse dimension of the first chamber is substantially the same as that of the second chamber, wherein the upper part of the first chamber vents to the atmosphere via the holes in the first front wall and the lower part of the first chamber leads to the water via the holes in the first front wall and wherein the upper part of the second chamber is isolated from the atmosphere and the lower part of the second chamber leads to the water in the first chamber via the holes in the second front wall.

12. A breakwater according to claim 10, wherein the base of the sea wall is set on a base block on the water bottom.

13. A breakwater according to claim 3, further including a plurality of vertical partition walls which cross transversely the whole transverse dimension of the breakwater at certain intervals in the longitudinal direction.

14. A breakwater according to claim 10, further including a plurality of vertical partition walls which cross transversely the whole transverse dimension of the breakwater at certain intervals in the longitudinal direction.

* * * * *